United States Patent [19]

Jones

[11] Patent Number: 4,788,801

[45] Date of Patent: Dec. 6, 1988

[54] RIDGE SYSTEM

[76] Inventor: Graham R. Jones, c/o Design Marketing, Lamberhead Industrial Estate, Wigan, United Kingdom, WN5 8EG

[21] Appl. No.: 14,458

[22] Filed: Feb. 13, 1987

[30] Foreign Application Priority Data

Feb. 13, 1986 [GB] United Kingdom ..... 8603589
Apr. 19, 1986 [GB] United Kingdom ..... 8609622

[51] Int. Cl.[4] ..... E04B 7/00
[52] U.S. Cl. ..... 52/57; 52/199
[58] Field of Search ..... 52/43, 57, 58, 199, 52/370, 712, DIG. 15; 98/42.2, 42.21

[56] References Cited

U.S. PATENT DOCUMENTS

| | | | |
|---|---|---|---|
| 2,191,979 | 2/1940 | Bierbach | 52/370 |
| 3,625,134 | 12/1971 | Smith | 52/199 X |
| 4,527,375 | 7/1985 | Braginetz | 52/712 |
| 4,554,862 | 11/1985 | Wolfert | 98/42.21 |
| 4,558,637 | 12/1985 | Mason | 52/199 X |
| 4,643,080 | 2/1987 | Trostle et al. | 52/199 X |
| 4,685,265 | 8/1987 | Cooper | 52/57 X |

FOREIGN PATENT DOCUMENTS 2030629 4/1980 United Kingdom .
2105384 3/1983 United Kingdom .

*Primary Examiner*—Carl D. Friedman
*Assistant Examiner*—Creighton Smith
*Attorney, Agent, or Firm*—Spensley Horn Jubas & Lubitz

[57] ABSTRACT

A roof ridge system includes an arrangement for weather-proofing the joints between ridge tiles and roof tiles and for providing ventilation to the roof space defined by such a system. The arrangement comprises between the ridge tiles and roof tiles, a perforated ventilator strip overlying and secured to a filler element profiled to conform with the profile of the roof tiles, the ventilator strip and profiled filler element defining therebetween air flow channels between the underside of the ridge tiles and outside atmosphere. The roof ridge system also includes, for supporting the ridge batten of the roof, a ridge batten with or without a support block adapted for mounting in the ridge bracket whereby the ridge tree batten can be supported at any one of three heights on the ridge. The roof ridge system also includes a ridge joint seal or gasket for sealing the joints of adjacent ridge tiles to prevent ingress of water and/or vermin. Finally, the roof ridge system includes a ventilation flow unit adapted to overlie the ridge tree batten and its securing brackets or brackets and support blocks.

60 Claims, 10 Drawing Sheets

RIDGE SYSTEM

This invention relates to a ridge system for the pitched roof of a building, the system being suitable for all pitched roofs.

It is an object of the present invention to provide a mechanically-assembled, dry, ventilated ridge system which replaces the traditional "wet" or cemented ridge systems.

Other objects of the present invention are to provide a mechanically-assembled, dry, ventilated ridge system which (a) ensures that the ridge tiles are secured to the apex of the roof; (b) seals the apex of the roof against ingress of water and vermin by sealing the joins between the ridge tiles and the joins between the ridge tiles and the roof tiles; and (c) which provides adequate ventilation from the roof cavity to the outside atmosphere.

According to a first aspect of the present invention there is provided in or for a roof ridge system an arrangement for weather-proofing the joints between ridge tiles and roof tiles incorporated in such a system and for providing ventilation to the roof space defined by such a system, the arrangement comprising, for location between the ridge tiles and roof tiles, a perforated ventilator strip overlying and secured to a filler element profiled to conform with the profile of the roof tiles, the ventilator strip and profiled filler element being adapted to define therebetween air flow channels between the underside of the ridge tiles and outside atmosphere.

Preferably, the perforated ventilator strip comprises along one side an upwardly open channel adapted to receive the lower edges of ridge tiles to secure the ventilator strip in position in the roof ridge system.

Preferably, the ventilator strip is formed along its length with a series of spaced perforations or slots.

Preferably, the profiled filler element on its underside which is adapted to contact the surface of the roof tiles is provided with at least one anti-capillary rib adapted to lie along the roof tiles and conform with the profile thereof.

Preferably, the profiled filler element defines longitudinally spaced alternating crests and valleys whereby the valleys define with the perforated ventilator strip the air flow channels.

Preferably, the profiled filler element comprises longitudinally spaced upstanding ribs on which the perforated ventilator strip rests to define with the profiled filler element the air flow channels.

According to a second aspect of the present invention there is provided a roof ridge system incorporating the hereinbefore defined weather proofing and ventilating arrangement disposed along each side of a ridge batten adapted to extend the length of the roof, the ridge batten being secured to rafters incorporated in the roof by at least one bracket comprising a base on which the ridge batten can rest, straps extending downwardly from the base for attachment to the rafters by nailing or screwing, and, at each end of the base, a pair of opposed ridge batten securing straps adapted to be folded around the batten in the overlying relationship and adapted to receive securing nails or screws.

Preferably there is a ridge batten support block adapted for mounting in the ridge bracket to support the ridge tree batten at a selected one of two heights above the base of the bracket.

Preferably the support block is provided on its upper surface with a channel defined by walls upstanding from the body of the support block, the height of the ridge tree batten above the base of the bracket being determined by the relative positions of the support block and bracket, i.e. with the channel aligned with the ridge tree batten in the roof ridge system so that the batten sits in the channel or at right angles to the ridge tree batten so that the latter sits on top of the walls of the channel.

Preferably the roof ridge system comprises a ridge joint seal or gasket for sealing the joins of adjacent ridge tiles to prevent ingress of water and/or vermin, the ridge joint seal or gasket being of T-configuration in transverse cross-section and being profiled to conform with the profile of the ridge tiles, the cross bar of the T defining a cap adapted to overlie a pair of adjacent ridge tiles with the stem of the T lying therebetween, there extending from one side only of the stem locating tabs spaced from the cap whereby a ridge tile on that side of the T of the ridge joint seal or gasket is engaged between the cap and location tabs.

Preferably the roof ridge system comprises a ventilation flow unit adapted to overlie the ridge tree batten and its securing brackets or brackets and support blocks, the ventilation flow unit comprising a cap adapted to be secured to the upper side of the ridge tree batten and depending walls adapted to lie alongside the ridge tree batten, the cap and walls being connected by hollow sloping shoulders.

An embodiment of the present invention will now be described by way of example with reference to the accompanying drawings in which.

Figure 1:
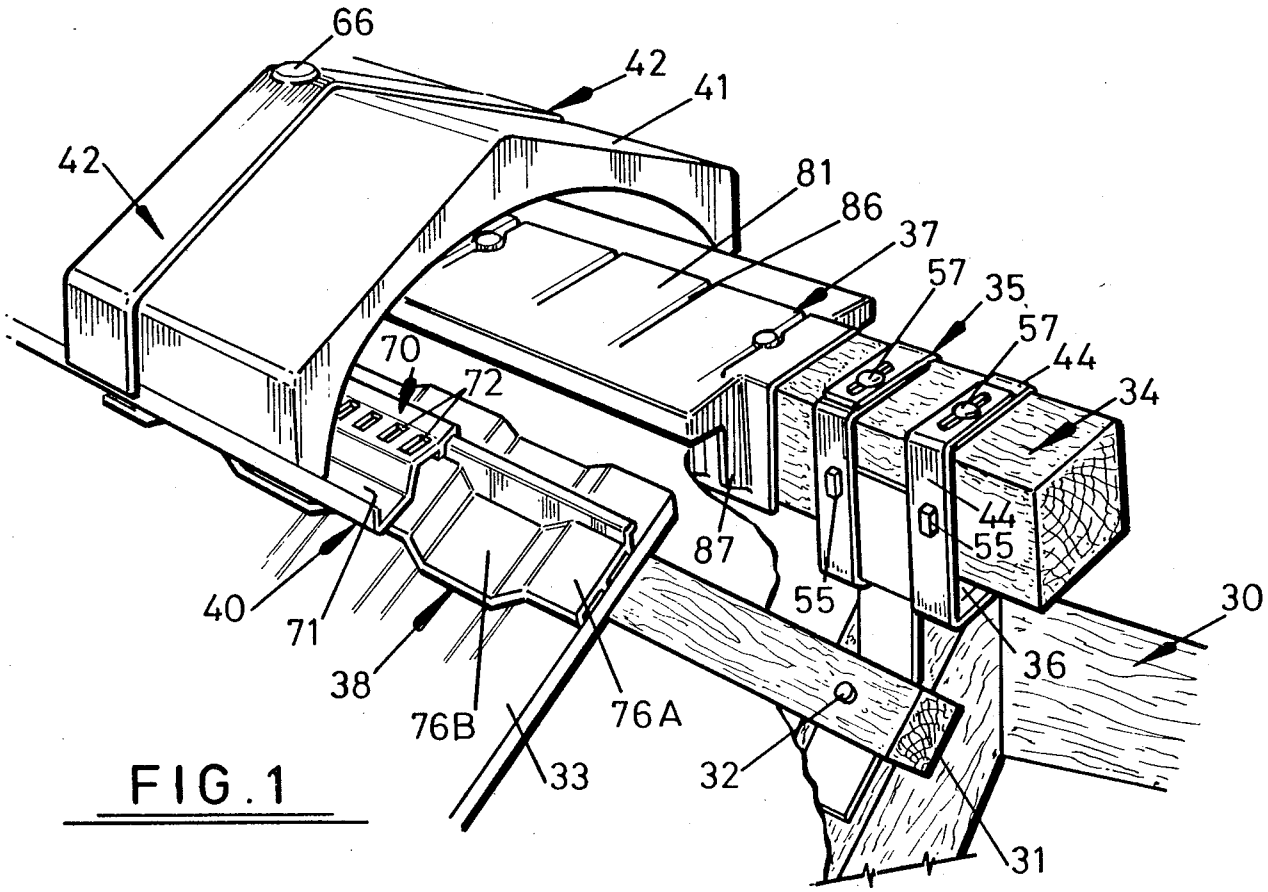
FIG. 1 is a fragmentary perspective view of a mechanically-assembled, dry, ventilated ridge system for a pitched roof according to the present invention.
Figure 3:
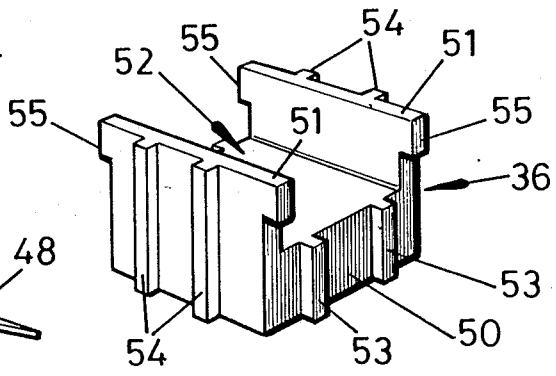
FIG. 3 is a perspective view of a ridge tree support block for use with the ridge tree bracket of FIG. 2.

The dry, ventilated, mechanically-assembled ridge system of the present invention generally comprises roof rafters 30 mounting tile battens 31 with the tile battens being secured to the rafters by nailing or screwing as indicated at 32. Roof tiles 33 are mounted and retained on the tile battens in conventional manner. At the apex of the roof is a ridge batten 34 secured in position by a batten bracket or connector 35 according to the present invention or a batten bracket and ridge tree support block 36 according to the present invention. Secured to the top of the ridge batten 34 is a ridge vent flow unit 37 according to the present invention with which is associated a profile filler 38 or 39 according to the present invention, and a ridge ventilator 40 according to the present invention. Ridge tiles 41 overlie the ridge batten and associated components and adjacent ridge tiles are sealed by a ridge joint seal or gasket 42 according to the present invention.

A more detailed description of the ridge system components now follows.

Reference is first made to FIGS. 2 to 6 which are concerned with the ridge tree bracket 35 and the ridge tree support block 36 according to the present invention. These components are concerned with the security of the dry, ventilated, mechanically-assembled ridge system.

As is customary the wooden ridge batten 34 requires to be fixed to the apex of the rafters 30. As is known to those skilled in the art the ridge batten 34 extends the full length of the roof apex and provides a means by which the ridge tiles 41 are secured in position by the ridge joint seal or gasket 42 as will be hereinafter described.

The ridge tree bracket 35 and ridge tree support block 36 allows a 50 millimeter square ridge tree batten 34 to be supported in one of three positions. It is to be noted that the quoted dimension of 50 milimeters square is only exemplary and not restrictive. The combination of these two components 35 and 36 permit the ridge tree batten 34 to be secured directly onto the ridge apex or a distance 25 millimeters above the apex, or at a distance of 50 millimeters above the apex. Again these dimensions are exemplary.

The choice of position of the ridge tree batten relative to the apex is dependent on the type of roof tile employed, the type of ridge tile employed and the pitch of the roof.

Figure 2:
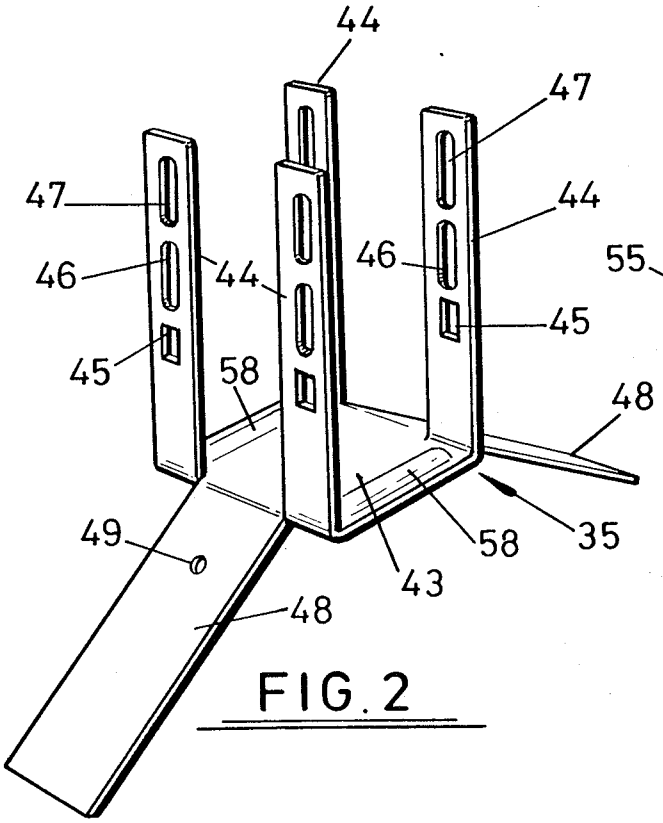
FIG. 2 is a perspective view of a ridge tree bracket for use in the ridge system of FIG. 1.

Referring firstly to FIG. 2 the ridge tree bracket is pressed from, for example, 0.5 millimeters stainless steel sheet and requires no fabrication. Here again the dimension 0.5 millimeters is exemplary and not restrictive. It comprises a square or rectangular base 43 with at each corner an upstanding batten strap 44 each strap comprising a bottom square opening 45 and two vertically spaced elongate slots 46 and 47, the purpose of which will be described later. Between a pair of straps 44 at one side of the ridge tree bracket 35 is an inclined depending securing strap 48 provided with one or more rafter nail holes 49.

The ridge tree support block comprises a solid body 50 at two opposed sides of which is an upstanding wall 51 defining a channel 52. The height of the walls 51 above the body 50 is equal to the height of the body. The two opposed sides of the body at right angles to the walls 51 are each provided with a pair of spaced bracket strap location ribs 53 while the other two sides of the body from which the walls 51 extend upwardly are each provided with a pair of parallel bracket strap location ribs 54 which extend the full height of the body 50 and wall 51. At the upper end of each wall 51, extending outwardly from each end of each wall 51, is a bracket slot tab 55. These tabs 55 are spaced above the upper surface of the body 50.

Figure 4:
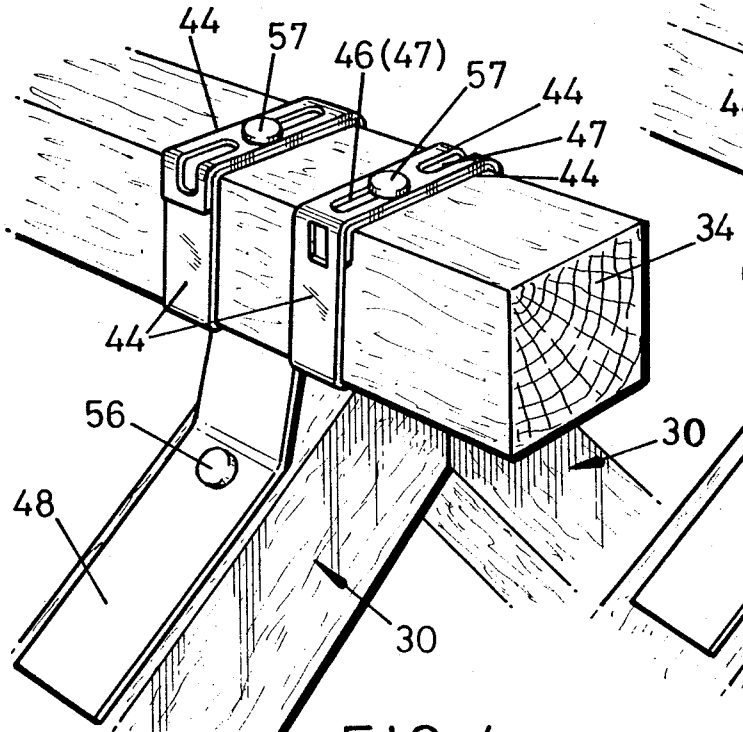

Reference is now made to FIG. 4 which shows the ridge tree batten 35 mounted and secured directly onto the ridge apex. In this instance the ridge tree support block 36 is not used. The ridge tree bracket 35 is nailed to the rafters at the apex of the roof by the securing straps 48 as shown, nails 56 being driven through the nail holes 49 into the rafters 30. The ridge tree batten 34 rests on the base 43 of the ridge tree bracket 35. The batten straps 44 are then wrapped around the ridge batten 34 to overlie three sides thereof, as can be seen, with one strap 44 overlying its opposite strap 44 and the folded and wrapped around straps 44 are secured in position by nails or screws 57 passing through the slot 46 of the top strap 44 and the slot 47 of the bottom strap 44. The ridge tree batten 34 is thus mechanically secured to the rafters 30 at the apex of the roof. It will be manifest that the ridge system comprises a number of spaced ridge tree brackets 35 along the length of the roof.

Figure 5:
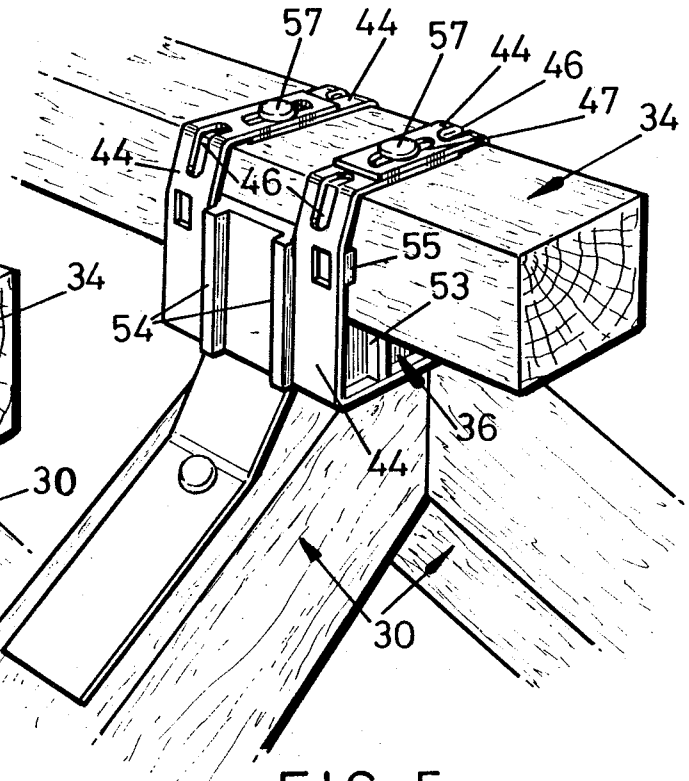
FIGS. 4 to 6 are respectively persepctive views showing the ridge tree bracket used to mount a ridge tree batten (FIG. 4), and the ridge tree bracket and ridge tree support block used to mount a ridge tree batten at different heights above the apex of the roof (FIGS. 5 and 6)

In FIG. 5 there is shown a ridge tree batten assembly with the ridge tree batten 34 secured 25 millimeters above the apex of the roof. In this instance the ridge tree support block 36 is seated in the ridge tree bracket 35 with the channel 52 uppermost and extending along the line of the apex of the roof. The ridge tree batten 34 sits in the channel 52. The bracket strap location ribs 54 abut the inner surfaces of the straps 44 of the ridge tree bracket 35 to locate the support block in position within the bracket 35. The straps 44 are again wrapped around the ridge tree batten 34 with one strap 44 overlying its opposite strap 44. In this instance the elongate slots 47 are aligned and securing nails or screws 57 are driven through these aligned slots 47 to secure the assembly of ridge tree bracket 35 and ridge trees support block 36 to the ridge tree batten 34. These straps 44, in this instance, are wrapped around only two sides of the ridge tree batten 34.

Figure 6:
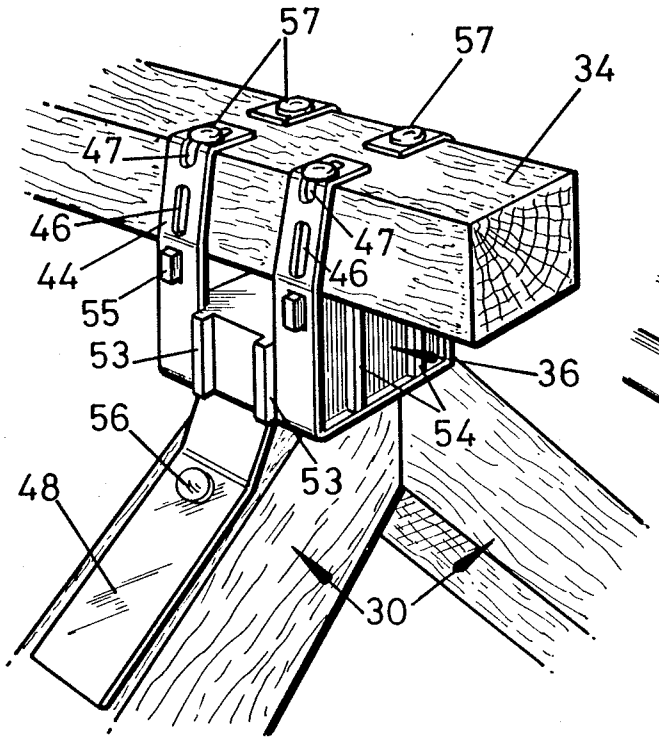

Turning now to FIG. 6 there is shown a ridge tree batten assembly with the ridge tree batten 34 secured 50 millimeters above the apex of the roof. This is achieved by turning the support block 36 through 90° so that the bracket strap location ribs 53 abut the inside of the batten strap location ribs 53 abut the inside of the batten straps 44 and the ridge tree batten 34, in this instance, rests on top of the walls 51. The bracket slot tabs 55 extend through the square holes 45 in the batten straps 44 and the latter are bent over the top of the ridge trees batten 34 and are secured by nails or screws 57 which pass through the elongate slots 47. In this instance again, the batten straps 44 engage only two sides of the ridge tree batten 34.

Referring again to FIG. 2 it is to be noted that the base 43 of the ridge tree bracket is provided with two raised surfaces 58. These serve to locate the support block 36 when it is used with the bracket 35 and to raise the ridge tree batten 34 clear of the base 43 when the ridge tree batten is directly secured to the apex to stop any moisture retention and consequent damage.

There is thus provided a versatile ridge tree batten mounting capable of mechanically securing the ridge tree batten in any one of three selected positions relative to the apex of the roof.

Figures 7, 8:
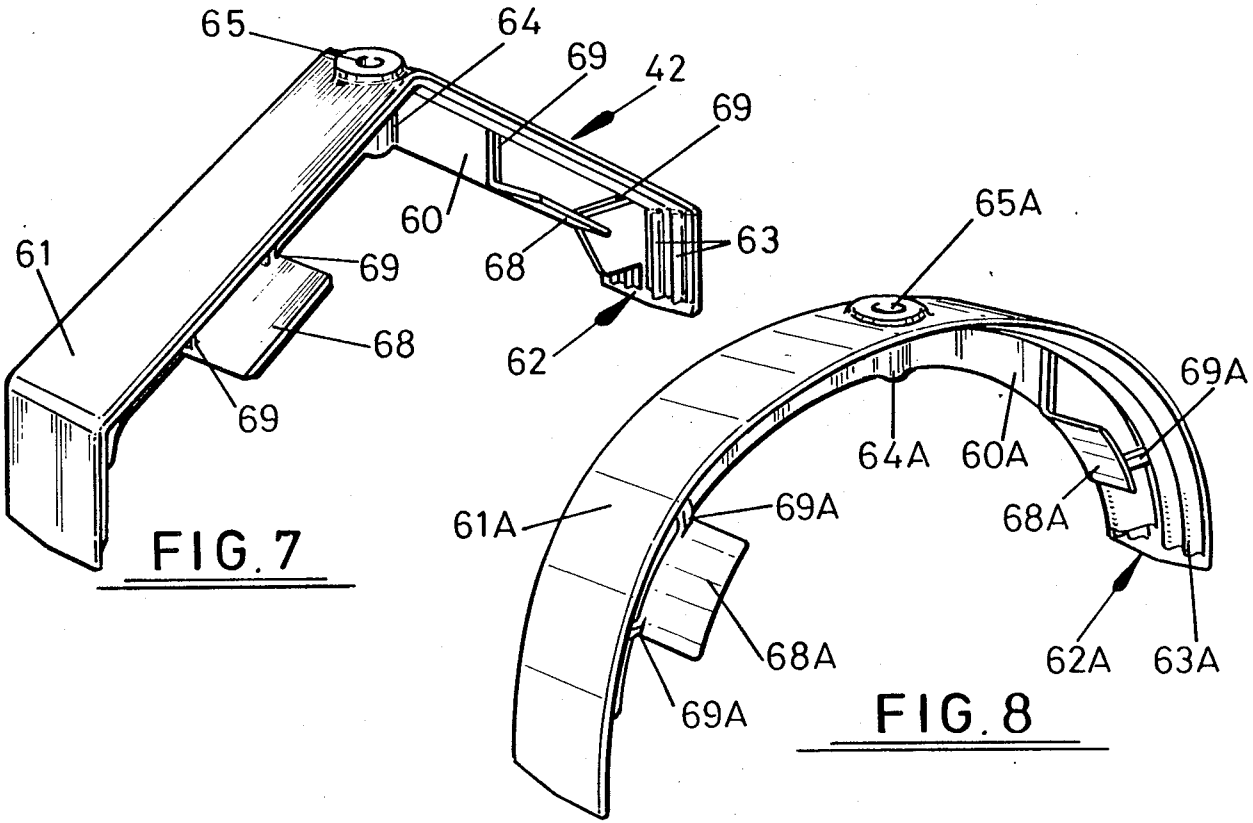
FIG. 7 is a perspective view of an angle ridge tile joint seal or gasket adapted to seal the joins between adjacent ridge tiles.
FIG. 8 is a perspective view of a half-round ridge joint seal or gasket.
Figure 9:
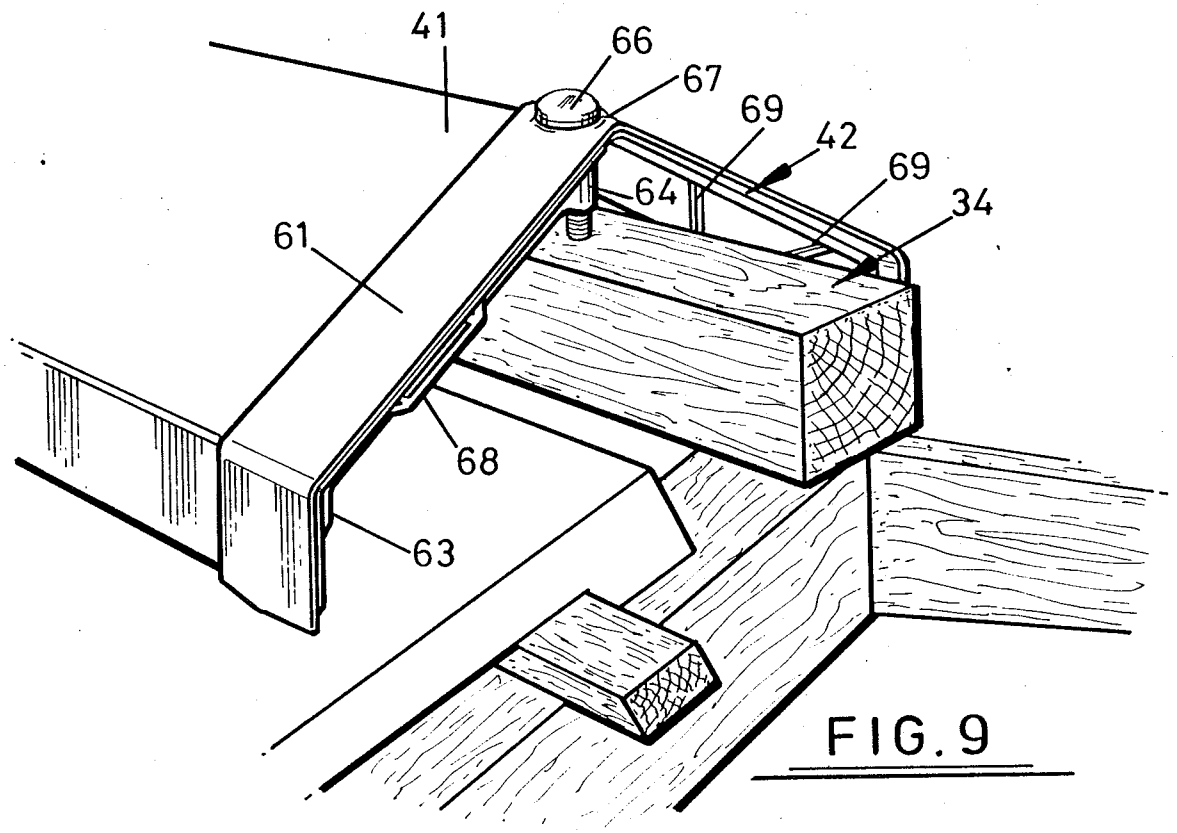
FIG. 9 is a fragmentary perspective view showing the angle ridge joint seal or gasket of FIG. 7 in use to seal the joins between adjacent ridge tiles.

Reference is now made to FIGS. 7 to 9 which are concerned with those components according to the present invention which seal the joins of adjacent ridge tiles to prevent ingress of water and/or vermin between said adjacent ridge tiles.

Two forms of ridge joint seals or gaskets are illustrated, that in FIG. 7 being designed to suit angle profile ridge tiles while that in FIG. 8 being designed to suit half-round profile ridge tiles. However, save for these differences in profile configuration, which are determined by the ridge tiles used, the ridge joint seal or gasket is identical in construction and function in each case.

Reference is made to FIG. 7 and it is to be noted that identical parts in FIG. 8 are designated by the same reference with the suffix "A". The ridge joint seal or gasket 42 comprises an injection moulded cap or T-shape in cross-section. The stem 60 of the T is disposed centrally of the cross-bar or cap 61 of the T and to the underside of the latter on each side of the stem 60 is an elastomeric (rubber) seal 62 which extends the length of the ridge joint seal or gasket 42 and is an extrusion comprising parallel sealing lips 63.

At the centre of the stem 60 of the joint seal gasket 42 is a sleeve 64 having a bore 65 for receiving a nail or screw 66 which is provided with a sealing washer 67 to lie under the head of the nail or screw 66. The latter is preferably but not essentially a ring-shank nail.

The stem 60 of the ridge joint seal or gasket is provided at one side with two transversely spaced location tabs 68 which fit under the ridge tile 41 on that side of the stem T. These location tabs 68 secure the ridge joint seal or gasket against any tendency to spread or deform due to the forces resulting from the driving in of the nail or screw 66.

At the tab locations there are provided ribs 69 on the face of the stem 60. These ribs 69 are of the same depth, i.e. outward projection from the face of the stem 60, as is the sleeve 64 around the nail hole 64. The ribs 69 perform the function of ensuring that the ridge joint seal or gasket sits evenly on the edge of the adjacent ridge tile 41.

In assembly the ridge joint seal 42 is fitted onto a ridge tile 41 i.e. a ridge tile edge is disposed between the cap 61 and tabs 68, so that the tabs 68 are located on the underside of the ridge tile with the rubber seal 62 firmly seated on the outer surface of the tile 41. The ridge tile is then positioned on the roof and the next and adjacent ridge tile is fitted to the ridge joint seal or gasket 42 i.e. under the cap 61 on the other side of the stem so that the second rubber seal 62 sits on the outer surface of this adjacent ridge tile 41.

The nail or screw 66 is now passed through the nail-hole 65 and driven into the ridge tree batten 34.

The rubber washer 67 ensures against water ingress.

The ridge tiles 41 are consequently mechanically secured to the ridge tree batten 34 by means of the ridge joint seals or gaskets 42 and the nails or screws 66.

It is preferred that the ridge joint seals are manufactured in unplasticised polyvinylchloride (UPVC) to give maximum durability and resistance to ultraviolet light and the rubber seals are preferably manufactured in extruded ethyl propylene diamene monomer.

As aforesaid it is preferred that ring shank nails 66 are employed and these are preferably formed of stainless steel.

Figure 10:
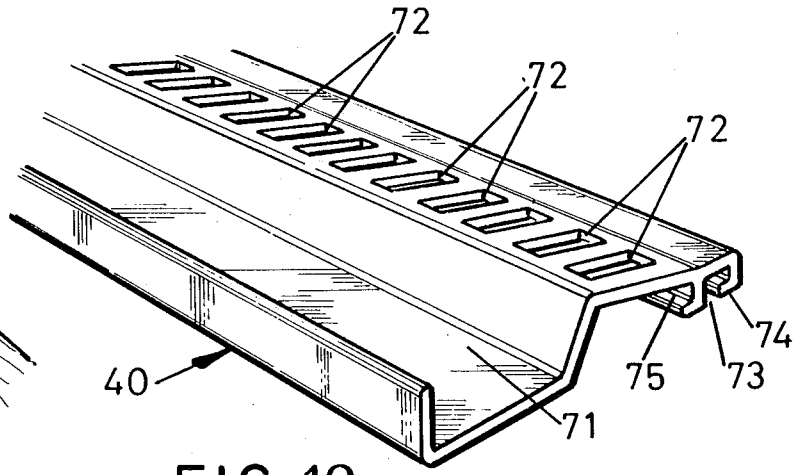
FIG. 10 is a perspective view of a ridge ventilator used in weather proofing a joint between a ridge tile and a roof tile.
Figure 11:
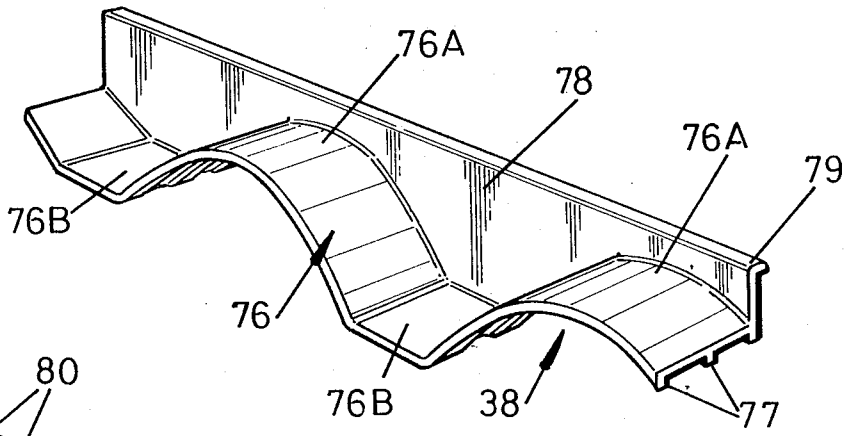
FIG. 11 is a perspective view of a ridge profile filler which is used with the ridge ventilator of FIG. 10.
Figure 12:
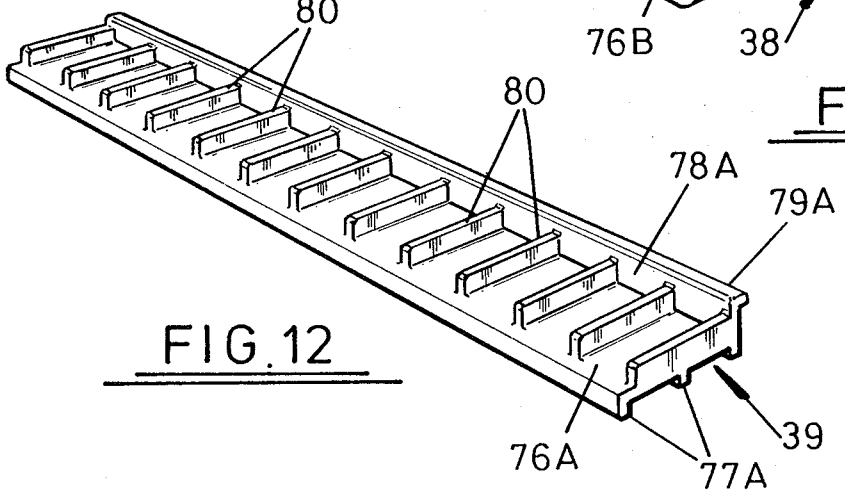
FIG. 12 is a perspective view of an alternative profile filler used with the ridge ventilator of FIG. 10 when the roof is clad with flat tiles.

Reference is now made to FIGS. 10 to 12 which illustrate a ridge ventilator and roof tile profile filler system which serves to weather-proof the joint between the ridge tiles and roof tiles where traditionally cement has been employed.

This system is an improvement over the "wet" cement system in that in addition to providing the aforesaid weather-proofing it also provides ventilation to the roof space in order to combat condensation.

The system comprises two separate components namely, a ridge ventilator 40 (FIG. 10) and a roof tile profile filler 38 (FIG. 11) or 39 (FIG. 12).

The ridge ventilator 40 is extruded from UPVC and fits under the edge of the ridge tiles 41 (see FIG. 1). The ridge ventilator 40 comprises a strip-like body 70 along one edge of which is an upwardly open channel 71 in which the bottom edges of the ridge tiles 41 sit to secure the ventilator 40 in position on the roof (see FIG. 1).

The strip-like body 70 is pierced along its length by a series of spaced perforations 72. These perforations 72 are produced during the extruding process by "on-line" punching. These perforations 72 serve to provide the aforesaid ventilation and they are designed to give, for example, more than 5,000 square millimeter ventilation per meter length of the ventilator. It is also to be noted that each individual perforation or slot 72 preferably has a width not exceeding 4 millimeters to prevent passage through these ventilation perforations or slots of large insects. Under the strip-like body 70 and at the edge remote from the channel 71 is a continuous socket or groove formation 73 extending the length of the ventilator, and having a return, inward flange 74.

An external rib 75 is formed on the groove formation 73 and extends towards the channel 71. This rib 72 tends to resist the penetration of windblown water which may pass through the ventilation perforations or slots 72.

Associated with the ridge ventilator 40 is a roof tile profile filler 38 which again is injection moulded from UPVC and has a configuration to conform with one of the range of available roof tile profiles.

One such profile filler is shown in FIG. 11 while a profile filler for flat roof tiles is shown in FIG. 12.

Referring to FIG. 11 the profile filler comprises a flange 76 which overlies the roof tiles 33 and conforms to their profiled configuration. Integral with the underside of the flange 76 are three parallel spaced ribs 77 which rest on the roof tiles and serve to create an anti-capillary effect to prevent ingress of water past the profile filler to the upper edge of the roof tiles 33.

The flange 76 has a vertical wall 78 with a return flange 79 at its upper edge, which flange 79 engages in the socket formation 73 of the ridge ventilator 40 thereby releasably to secure the profile filler 38 and ridge ventilator 40 together. The return flange 79 is a snap-fit in the socket formation 73.

Due to the profile of the profile filler 38 of FIG. 11, which provides longitudinally-spaced crests 76A and valleys 76B, channels for air flow between the underside of the ridge tiles 41 (through the ventilator slots 72) and the outside atmosphere are provided when the ridge ventilator 40 overlies the profile filler 38.

It will be manifest from viewing FIG. 1 that the ridge tiles 41 lock the ridge ventilator 40 and roof tile profile filler 38 in position, i.e. these two latter components are mechanically secured or clamped in position and perform the aforesaid dual function of weather proofing the joint between the ridge tiles 41 and roof tiles 33 while permitting ventilation to the roof space through the perforations or slots 72.

Referring now to FIG. 12 which shows a profile filler for flat tiles, parts identical with those of the profile filler of FIG. 11 are indicated by the same references with the suffix "A".

Due to the fact that air which escapes through the perforations or slots 72 of the ventilator 40 relies on the depth of the roof tile profile for passage to the outside atmosphere (see FIG. 1) it is necessary where a flat roof tile is used to provide on the top surface of the profile filler a support for the ventilator 40. This is achieved by providing on the flange 76A a number of spaced parallel vertical ribs 80 to support the ventilator 40. These ribs 80 create channels through which the air can pass to outside atmosphere.

Figure 13:
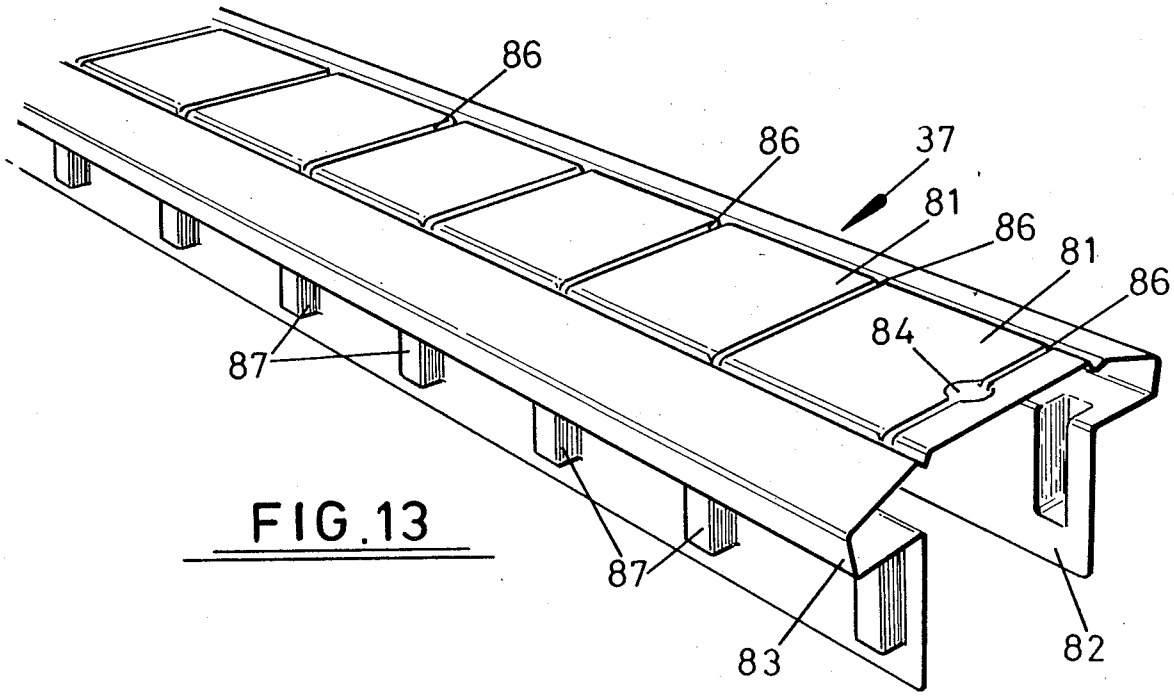
FIG. 13 is a perspective view of a ridge vent flow unit employed for water drainage and ventilation from the roof space to atmosphere.
Figure 14:
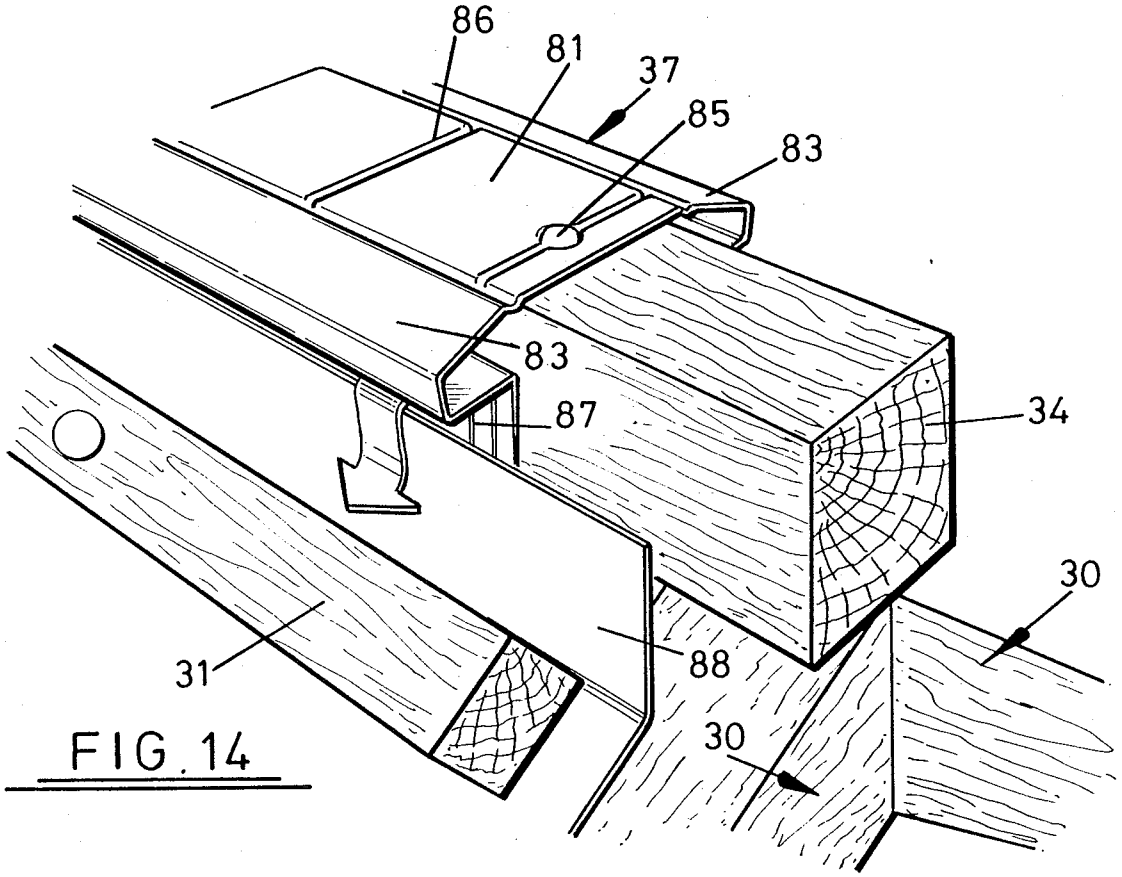
FIG. 14 is a fragmentary perspective view showing the ridge vent flow unit fitted in position on a ridge tree batten.

Reference is now made to FIGS. 13 and 14 which show the ridge vent flow unit 37 which is part of the total dry ventilated mechanically assembled ridge system of the present invention.

The ridge vent flow unit 37 is vacuum formed from UPVC sheet as a flat tray and is heat bent into a U-section to fit over the ridge tree batten 34, for example a 50 millimeter square ridge tree batten. The ridge vent flow unit 37 therefore comprises a cap 81 with vertical walls 82 joined together by hollow sloping shoulders 83.

The ridge vent flow unit 37 is provided with spaced circular recesses to accommodate the heads of securing nails 85 driven into the top surface of the ridge tree batten 34. There are for example three circular recesses along a 750 millimeter length of ridge vent flow unit 37.

The cap 81 is formed with spaced parallel inwardly directed i.e. depressed ribs 86 to hold the ridge vent flow unit 37 clear of the ridge tree batten 34 thus minimising retention of moisture which may rot the wood of the ridge tree batten 34.

The ridge vent flow unit 37 is assembled in sections along the length of the ridge tree batten 34 and at one end of each ridge vent flow unit 37 the overall dimensions are reduced to allow the next adjacent unit 37 to be overlaid so that one securing nail 85 can pass through both.

The walls 82 have a series of hollow intermittent projections 87 to support roofing felt 88.

The roofing felt 88 lies against these projections 87 and consequently with the projections 87 defines air or ventilation spaces, the roofing felt 88 stopping short of the hollow shoulders 83 and lying inwardly under these shoulders 83 against the surfaces of the hollow projections 87.

Thus the air space beneath the felt 82 is ventilated through the gaps between the projections 87 into the ridge space.

It is to be noted that if the felt 88 was allowed to rest against the ridge tree batten 34 then not only would the roof space be unventilated but the suction effect created by the ridge ventilator 40 and the profile filler 38 or 39 would act on the space between the roof tiles 33 and the felt 88 to create an ingress of water through the tile joints.

The hollow shoulders 83 overlie the felt 88 and due to their sloping configuration provide two continuous drainage lips which direct water (either from condensation or ingress through ridge tile joints) onto the roof felt 88.

It is to be noted that the ridge vent flow unit 37 overlies the ridge tree batten 34 and the batten connectors i.e. brackets 35 or brackets 35 and support blocks 36 in the assembled ridge system.

The present invention as described above therefore provides a dry, ventilated, mechanically-assembled ridge system suitable for all pitched roofs.

The roof assembly would preferably be completed by the dry verge system as is disclosed in British Patent Application No. 85 04876 filed Feb. 26, 1985.

The abovedescribed ridge system can be modified to a non-ventilated configuration which would be desirable, inter alia, where gas flue terminals are provided in the roof space.

Thus according to this modification no spaced perforations or slots are provided in the ventilator strip.

The strip consequently simply serves to seat the edges of the ridge tiles relative to the profiled filler element and consequently the roof tiles with which the profiled filler registers.

Figure 15:
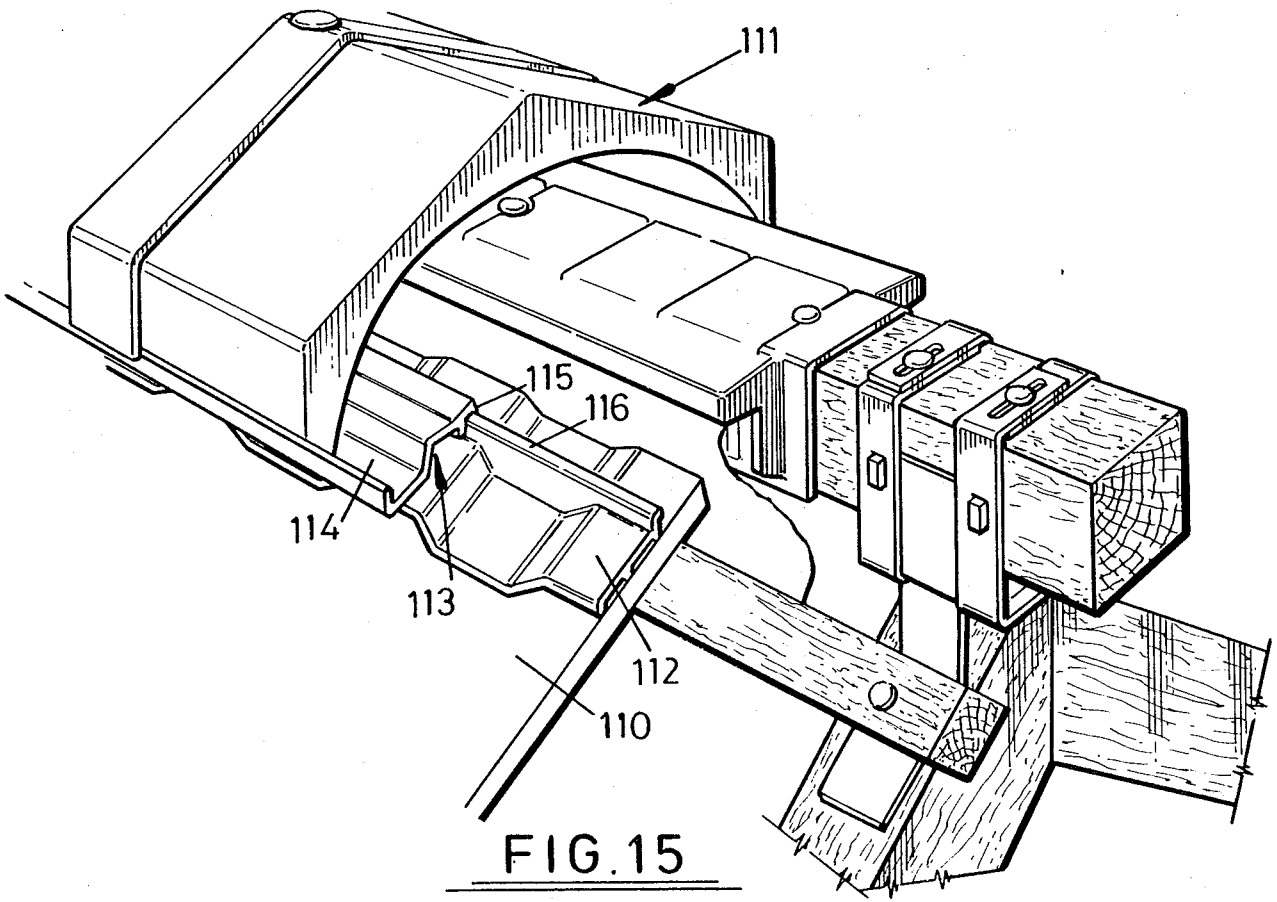
FIG. 15 is a fragmentary perspective view corresponding to FIG. 1 of a modification of the ridge system without ventilation used, for example, when gas flue terminals are provided in the roof space.

In FIG. 15 of the drawings showing this modification, the roof tiles are indicated at 110 and the ridge tiles at 111.

Between the roof tiles 110 and the lower edges of the ridge tiles 111 are located a filler element 112 profiled to register with the shape or configuration of the roof tiles 110 and a locator strip 113 which has an upwardly-open channel 114 to receive the lower edges of the ridge tiles 111 and a downwardly-open groove formation 115 to engage a flange 116 of the filler element 112 for securement purposes.

Otherwise the ridge system is as described with reference to FIGS. 1 to 14.

What is claimed is:

1. An arrangement for weatherproofing joints between ridge tiles and roof tiles incorporated in a roof ridge system of a building and for providing ventilation to a roof space of the building defined by the roof ridge system, the weatherproofing and ventilation arrangement being adapted for location between the ridge tiles and the roof tiles, and comprising a perforated ventilator strip having along one side thereof an upwardly open channel adapted to receive the lower edges of the ridge tiles to secure the ventilator strip in position in the roof ridge system, a filler element adapted for location between the perforated ventilator strip and the roof tiles and profiled to conform with the profile of the roof tiles, the perforated ventilator strip and the filler element defining between them air flow channel means between the underside of the ridge tiles and the atmosphere outside the roof space of the building, and means interconnecting the perforated ventilator strip and the filler element.

2. An arrangement as claimed in claim 1, in which the ventilator strip is formed along its length with a series of spaced perforations or slots.

3. An arrangement as claimed in claim 1 in which the ventilator strip is provided on its underside at its edge spaced from the channel with a socket or groove formation constituting a first part of the means interconnecting the ventilator strip and the filler element.

4. An arrangement as claimed in claim 3, in which the socket or groove formation has a return inward flange directed towards the channel.

5. An arrangement as claimed in claim 3, in which the socket or groove formation has an external rib directed towards the channel for the purpose of resisting penetration of wind blown water when the ventilator strip is fitted into the roof ridge system.

6. An arrangement as claimed in claim 1, in which the profiled filler element comprises a flange with along one edge an upstanding wall having a male formation adapted to engage in the socket or groove formation of the perforated ventilator strip and constituting a second part of the means interconnecting the ventilator strip and the filler element, the first and second parts constituting the means interconnecting the filler element and the perforated ventilator strip.

7. An arrangement as claimed in claim 6, in which the interconnecting first and second parts are releasable one from another.

8. An arrangement as claimed in claim 7, in which the male formation constituting the first part is a snap-fit in the socket or groove formation constituting the second part.

9. An arrangement as claimed in claim 1, in which the filler element, on its underside which is adapted to contact the surface of the roof tiles, is provided with at least one anti-capillary rib adapted to lie along the roof tiles and conform with the profile thereof.

10. An arrangement as claimed in claim 9, in which the underside of the filler element is provided with a plurality of spaced parallel anti-capillary ribs parallel with the apex of the roof ridge system when the filler element is in position therein.

11. An arrangement as claimed in claim 1, in which the filler element defines longitudinally spaced alternating crests and valleys whereby the valleys define with the perforated ventilator strip the air flow channel means.

12. An arrangement as claimed in claim 1, in which the filler element comprises longitudinally spaced upstanding ribs on which the perforated ventilator strip rests to define with the filler element the air flow channel means.

13. A mounting arrangement for securing a ridge batten of a roof ridge system of a building to, and longitudinally of rafters of the bulding, the mounting arrangement comprising at least one bracket comprising a base on which the ridge batten can rest, straps extending downwardly from the base for attachment to the rafters by nailing or screwing, and, at each end of the base, a pair of opposed ridge batten securing straps adapted to be folded around the batten in overlying relationship and adapted to receive securing nails or screws, and a ridge batten support block adapted for mounting on the base of the ridge bracket in either of two orientations to support the ridge tree batten at a selected one of two heights above the base of the bracket.

14. A mounting arrangement as claimed in claim 13, in which each rafter attachment strap lies between a pair of the ridge batten securing straps and is formed with at least one nail or screw receiving hole.

15. A mounting arrangement as claimed in claim 13 in which each ridge batten securing strap is provided with a plurality of vertically spaced slots for securement purposes.

16. A mounting arrangement as claimed in claim 13, in which the support block comprises a body, whereof the upper surface comprises a channel defined by walls upstanding from the body of the support block, the height of the ridge tree batten above the base of the bracket being determined by the relative positions of the support block and bracket, i.e. with the channel aligned with the ridge tree batten in the roof ridge system so that the batten sits in the channel or at right angles to the ridge tree batten so that the latter sits on top of the walls of the channel.

17. A mounting arrangement as claimed in claim 16 in which the body of the support block is of rectangular formation and is provided on each of its four facs with bracket strap location ribs against which the ridge batten securing straps abut, and lateral tabs at the upper end of each side of each channel-defining wall adapted for engagement in a slot of each ridge tree batten securing strap when the ridge tree batten is supported on top of the walls of the support block.

18. A ridge joint seal for sealing the joints of adjacent ridge tiles of a roof ridge system to prevent ingress of water and vermin, the ridge joint seal being of T-configuration in transverse cross-section and being profiled to conform with the profile of the ridge tiles, the cross bar of the T defining a cap adapted to overlie a pair of adjacent ridge tile with the stem of the T lying therebetween, and there being provided locating tabs extending from one side only of the stem and spaced from the cap whereby a ridge tile on said one side of the T of the ridge joint seal is engaged between the cap and the location tabs.

19. A ridge joint seal as claimed in claim 18 comprising, centrally of the ridge joint seal and at the upper end thereof, a sleeve defining a nail or screw receiving hole.

20. A ridge joint seal as claimed in claim 19 comprising, at each side of the stem of the T, a sealing strip provided underneath the cap to engage the upper surface of a ridge tile at that side of the T in the assembled roof ridge system.

21. A ridge joint seal as claimed in claim 20, in which each sealing strip extends the length of the cap and comprises a plurality of parallel sealing ridge.

22. A ridge joint seal as claimed in claim 18, comprising ribs on each face of the T of a depth, i.e., outward projection, equal to that of the sleeve whereby the ridge joint seal sits evenly on the edge of the adjacent ridge tiles.

23. A roof ridge system for the roof of a building, whereof the roof is constituted by longitudinally-spaced, transversely-extending rafters to which are secured roof tiles, a ridge batten secured to the rafters and extending longitudinally thereof, and ridge tiles overlying the ridge batten and adjacent ridge tiles and being secured to the ridge batten, the roof ridge system comprising, in combination, an arrangement for weatherproofing joints between the ridge tiles and adjacent roof tiles and for providing ventilation to a roof space enclosed by the roof, and a mounting arrangement for securing the ridge batten to the rafters of the roof, the weatherproofing and ventilation arrangement being adapted for location between the ridge tiles and the roof tiles, and comprising a perforated ventilator strip having along one side thereof an upwardly open channel adapted to receive the lower edges of the ridge tiles to secure the ventilator strip in position in the roof ridge system, a filler element adapted for location between the perforated ventilator strip and the roof tiles and profiled to conform with the profile of the roof tiles, the perforated ventilator strip and the filler element defining between them air flow channel means between the underside of the ridge tiles and the atmosphere outside the roof space of the building, and means interconnecting the perforated ventilator strip and the filler element; and the batten ridge mounting arrangement comprising at least one bracket comprising a base on which the ridge batten can rest, straps extending downwardly from the base for attachment to the rafters by nailing or screwing, and, at each end of the base, a pair of opposed ridge batten securing straps adapted to be folded around the batten in overlying relationship and adapted to receive securing nails or screws, and a ridge batten support block adapted for mounting on the base of the ridge bracket in either of two orientations to support the ridge tree batten at a selected one of two heights above the base of the bracket.

24. A roof ridge system as claimed in claim 23, in which the ventilator strip is formed along its length with a series of spaced perforations or slots.

25. A roof ridge system as claimed in claim 23 in which the ventilator strip is provided on its underside at its edge spaced from the channel with a socket or groove formation constituting a first part of the means interconnecting the ventilator strip and the filler element.

26. A roof ridge system as claimed in claim 25, in which the socket or groove formation has a return inward flange directed towards the channel.

27. A roof ridge system as claimed in claim 26, in which the socket or groove formation has an external rib directed towards the channel for the purpose of resisting penetration of wind blown water when the ventilator strip is fitted into the roof ridge system.

28. A roof ridge system as claimed in claim 23, in which the profiled filler element comprises a flange with along one edge an upstanding wall having a male formation adapted to engage in the socket or groove formation of the perforated ventilator strip and constituting a second part of the means interconnecting the ventilator strip and the filler element, the first and second parts constituting the means interconnecting the filler element and the perforated ventilator strip.

29. A roof ridge system as claimed in claim 28, in which the interconnecting first and second parts are releasable one from another.

30. A roof ridge system as claimed in claim 29, in which the male formation constituting the first part is a snap-fit in the socket or groove formation constituting the second part.

31. A roof ridge system as claimed in claim 23, in which the filler element, on its underside which is adapted to contact the surface of the roof tiles, is provided with at least one anti-capillary rib adapted to lie along the roof tiles and conform with the profile thereof.

32. A roof ridge system as claimed in claim 23, in which the underside of the filler element is provided with a plurality of spaced parallel anti-capillary ribs parallel with the apex of the roof ridge system when the filler element is in position therein.

33. A roof ridge system as claimed in claim 23, in which the filler element defines longitudinally spaced alternating crests and valleys whereby the valleys define with the perforated ventilator strip the air flow channel means.

34. A roof ridge system as claimed in claim 23, in which the filler element comprises longitudinally spaced upstanding ribs on which the perforated ventilator strip rests to define with the filler element the air flow channel means.

35. A roof ridge system as claimed in claim 23, in which each rafter attachment strap lies between a pair of the ridge batten securing straps and is formed with at least one nail or screw receiving hole.

36. A roof ridge system as claimed in claim 23 in which each ridge batten securing strap is provided with a plurality of vertically spaced slots for securement purposes.

37. A roof ridge system as claimed in claim 23, in which the support block comprises a body, whereof the upper surface comprises a channel defined by walls upstanding from the body of the support block, the height of the ridge tree batten above the base of the bracket being determined by the relative positions of the support block and bracket, i.e., with the channel aligned with the ridge tree batten in the roof ridge system so that the batten sits in the channel or at right angles to the ridge tree batten so that the latter sits on top of the walls of the channel.

38. A roof ridge system as claimed in claim 37 in which the body of the support block is of rectangular formation and is provided on each of its four faces with bracket strap location ribs against which the ridge batten securing straps abut, and lateral tabs at the upper end of each side of each channel-defining wall adapted for engagement in a slot of each ridge tree batten securing strap when the ridge tree batten is supported on top of the walls of the support block.

39. A roof ridge system as claimed in claim 23 comprising a ridge joint seal for sealing the joints of adjacent ridge tiles to prevent ingress of water and vermin and for securing the ridge tiles to the ridge batten, the ridge joint seal being of T-configuration in transverse cross-section and being profiled to conform with the profile of the ridge tiles, the cross bar of the T defining a cap adapted to overlie a pair of adjacent ridge tiles with the stem of the T lying therebetween, and there being provided locating tabs extending from one side only of the stem and spaced from the cap whereby a ridge tile on said one side of the T of the ridge joint seal is engaged between the cap and the location tabs.

40. A roof ridge system as claimed in claim 39, comprising, centrally of the ridge joint seal and at the upper end thereof, a sleeve defining a nail or screw receiving hole for reception of a nail or screw to secure the ridge joint seal and consequently adjacent ridge tiles to the ridge batten.

41. A roof ridge system as claimed in claim 40 comprising, at each side of the stem of the T, a sealing strip provided underneath the cap to engage the upper surface of a ridge tile at that side of the T in the assembled roof ridge system.

42. A roof ridge system as claimed in claim 41, in which each sealing strip extends the length of the cap and comprises a plurality of parallel sealing ridges.

43. A roof ridge system as claimed in claim 39 comprising ribs on each face of the T of a depth, i.e. outward projection, equal to that of the sleeve whereby the roof ridge system sits evenly on the edge of the adajacent ridge tiles.

44. A roof ridge system as claimed in claim 23, comprising a ventilation flow unit adapted to overlie the ridge tree batten and each ridge batten securing bracket and support block, the ventilation flow unit comprising a cap adapted to be secured to the upper side of the ridge tree batten and depending walls adapted to lie alongside the ridge batten, the cap and walls being connected by hollow sloping shoulders.

45. A roof ridge system unit as claimed in claim 44, comprising, on the underside of the flow unit cap, ribs for holding the unit clear of the ridge batten to minimise moisture retention.

46. A roof ridge system as claimed in claim 44, in which the flow unit walls are provided with a series of hollow spaced projections adapted to support roofing felt spaced from the walls thereby to provide air flow passages or ventilation spaces therebetween.

47. A roof ridge system as claimed in claim 46, in which the sloping shoulders of the ventilation flow unit overlie the edge of the roofing felt and provide drainage lips adapted to direct water onto the top of the roofing felt and clear of the air flow passages.

48. A roof ridge system for the roof of a building, whereof the roof comprises longitudinally-spaced, transversely-extending rafters, a ridge batten secured to the rafters and extending longitudinally thereof, and ridge tiles overlying and secured to the ridge batten, the roof ridge system comprising, in combination, a mounting arrangement for securing the ridge batten to the rafters of the roof, and a ridge joint seal for sealing the joints of adjacent ridge tiles to prevent ingress of water and vermin and for securing the ridge tiles to the ridge batten, the ridge batten mounting arrangement comprising at least one bracket comprising a base on which the ridge batten can rest, straps extending downwardly from the base for attachment to the rafters by nailing or screwing, and, at each end of the base, a pair of opposed ridge batten securing straps adapted to be folded around the batten in everlying relationship and adapted to receive securing nails or screws, and a ridge batten support block adapted for mounting on the base of the ridge bracket in either of two orientations to support the ridge tree batten at a selected one of two heights above the base of the bracket; and the ridge joint seal being of T-configuration in transverse cross-section and being profiled to conform with the profile of the ridge tiles, the cross bar of the T defining a cap adapted to overlie a pair of adjacent ridge tiles with the stem of the T lying therebetween, and there being provided locating tabs extending from one side only of the stem and spaced from the cap whereby a ridge tile on said one side of the T of the ridge joint seal is engaged between the cap and the location tabs.

49. A roof ridge system as claimed in claim 48, in which each rafter attachment strap lies between a pair of the ridge batten securing straps and is formed with at least one nail or screw receiving hole.

50. A roof ridge system as claimed in claim 48 in which each ridge batten securing strap is provided with a plurality of vertically spaced slots for securement purposes.

51. A roof ridge system as claimed in claim 48, in which the support block comprises a body, whereof the upper surface comprises a channel defined by walls upstanding from the body of the support block, the height of the ridge tree batten above the base of the bracket being determined by the relative positions of the support block and bracket, i.e., with the channel aligned with the ridge tree batten in the roof ridge system so that the batten sits in the channel or at right angles to the ridge tree batten so that the latter sits on top of the walls of the channel.

52. A roof ridge system as claimed in claim 51 in which the body of the support block is of rectangular formation and is provided on each of its four faces with bracket strap location ribs against which the ridge batten securing straps abut, and lateral tabs at the upper end of each side of each channel-defining wall adapted for engagement in a slot of each ridge tree batten securing strap when the ridge tree batten is supported on top of the walls of the support block.

53. A roof ridge system as claimed in claim 48, comprising, centrally of the ridge joint seal and at the upper end thereof, a sleeve defining a nail or screw receiving hole for reception of a nail or screw to secure the ridge joint seal and consequently adjacent ridge tiles to the ridge batten.

54. A roof ridge system as claimed in claim 53 comprising, at each side of the stem of the T, a sealing strip provided underneath the cap to engage the upper surface of a ridge tile at that side of the T in the assembled roof ridge system.

55. A roof ridge system as claimed in claim 54, in which each sealing strip extends the length of the cap and comprises a plurality of parallel sealing ridges.

56. A roof ridge system as claimed in claim 48, comprising ribs on each face of the T of a depth, i.e., outward projection, equal to that of the sleeve whereby the roof ridge system sits evenly on the edge of the adjacent ridge tiles.

57. A roof ridge system as claimed in claim 48, comprising a ventilation flow unit adapted to overlie the ridge tree batten and each ridge batten securing bracket and support block, the ventilation flow unit comprising a cap adapted to be secured to the upper of the ridge tree batten and depending walls adapted to lie alongside the ridge batten, the cap and walls being connected by hollow sloping shoulders.

58. A roof ridge system unit as claimed in claim 57, comprising, on the underside of the flow unit cap, ribs for holding the unit clear of the ridge batten to minimise moisture retention.

59. A roof ridge system as claimed in claim 57 in which the flow unit walls are provided with a series of hollow spaced projections adapted to support roofing felt spaced from the walls thereby to provide air flow passages or ventilation spaces therebetween.

60. A roof ridge system as claimed in claim 59 in which the sloping shoulders of the ventilation flow unit overlie the edge of the roofing felt and provide drainage lips adapted to direct water onto the top of the roofing felt and clear of the air flow passages.

* * * * *